US007371949B2

(12) United States Patent
Sawhney et al.

(10) Patent No.: US 7,371,949 B2
(45) Date of Patent: May 13, 2008

(54) MUSICAL INSTRUMENT HAVING EXCHANGEABLE COMPONENTS

(75) Inventors: Ravi K. Sawhney, Calabasas, CA (US); Paul Janowski, Ventura, CA (US); Timothy M. Nugent, Venice, CA (US); Glen G. Kim, Los Angeles, CA (US)

(73) Assignee: RKS Guitars, LLC, Oxnard, CA (US)

( * ) Notice: Subject to any disclaimer, the term of this patent is extended or adjusted under 35 U.S.C. 154(b) by 126 days.

(21) Appl. No.: 10/910,561

(22) Filed: Aug. 2, 2004

(65) Prior Publication Data

US 2005/0132866 A1 Jun. 23, 2005

Related U.S. Application Data

(63) Continuation of application No. 10/307,184, filed on Nov. 27, 2002, now Pat. No. 6,809,245.

(60) Provisional application No. 60/386,365, filed on Jun. 6, 2002.

(51) Int. Cl.
*G10D 3/00* (2006.01)

(52) U.S. Cl. ..... 84/291

(58) Field of Classification Search ..... 84/291, 84/293, 267, 384, 387 R, 411 R
See application file for complete search history.

(56) References Cited

U.S. PATENT DOCUMENTS

| | | | | |
|---|---|---|---|---|
| 4,185,534 | A | 1/1980 | Cove | |
| 4,201,108 | A | 5/1980 | Bunker | |
| 4,475,434 | A | 10/1984 | Willis | |
| 4,539,886 | A | 9/1985 | Hoffart | |
| 4,714,000 | A | 12/1987 | Braun | |
| 5,682,003 | A | 10/1997 | Jarowsky | |
| 5,847,300 | A | 12/1998 | Hackl | |
| 5,911,168 | A | 6/1999 | Enserink | |
| 6,188,005 | B1 * | 2/2001 | White | 84/291 |
| 6,255,567 | B1 | 7/2001 | Minakuchi | |
| 6,376,756 | B1 | 4/2002 | Beckmeier | |

* cited by examiner

*Primary Examiner*—Kimberly Lockett
(74) *Attorney, Agent, or Firm*—Daniel P. Dooley; Fellers, Snider, et al.

(57) ABSTRACT

A musical instrument having exchangeable components. The musical instrument may include a core portion providing a foundation for the musical instrument and a body portion removably attached to the core portion. Exchanging a body portion for another portion may alter the tonal, structural or aesthetic characteristics of the instrument. The musical instrument may be a stringed musical instrument, such as a guitar, for example, or may be a woodwind, horn or percussion instrument.

36 Claims, 17 Drawing Sheets

MUSICAL INSTRUMENT HAVING EXCHANGEABLE COMPONENTS

CROSS-REFERENCE TO RELATED APPLICATIONS

This application is a continuation of U.S. application Ser. No. 10/307,184 filed Nov. 27, 2002, now U.S. Pat. No. 6,809,245, which claims priority to U.S. Provisional Application Ser. No. 60/386,365, filed Jun. 6, 2002, entitled "Stringed Musical Instrument."

BACKGROUND

1. Field of the Invention

The present invention relates to the field of musical instruments and, in particular, to musical instruments having components that can be exchanged for other components.

2. Description of Related Art

Innovation in the musical instrument arts is relatively infrequent. The basic design of many musical instruments has not changed in several hundred years. For example, the modern violin has essentially the same basic design today as it did in the $16^{th}$ century. The basic design of a piano as we know it today is relatively unchanged today from its beginnings in the early $18^{th}$ century. The same can be said for many woodwind and brass instruments also.

One of the last true innovations in the musical instrument arts occurred in the 1940s and 1950s, when the pioneering work of Les Paul and Leo Fender transformed the guitar from an acoustic instrument to an electric instrument. In a modern electric guitar, magnetic "pickups," formed by winding a coil around magnetic pole pieces, sense vibrations from metal strings on the guitar, portions of which are located within the magnetic field of the pole pieces. The vibration of the metal strings modulates the magnetic field of the pole pieces, which, in turn, induces a current signal in the windings of the coil. This signal is sent to an electronic amplifier, which amplifies the signal into an audible sound.

Guitar players can change the sound produced by an electric guitar by changing the guitar's pickups, which are available in a wide variety of styles and with a wide variety of tonal characteristics. However, the sounds generated by a guitar begin with a vibrating string. Although a guitar's pickup may affect how the vibrations of the guitar strings are processed, the structural characteristics of the guitar itself are what determine the nature of the string's vibration and, consequently, the tonal qualities or timbre of the guitar. Thus, legendary electric guitars such as the Gibson LES PAUL and the Fender STRATOCASTER and TELECASTER have unique tonal characteristics not only because of the particular type of pickups used on those guitars, but also because of the unique structural design and shape of the guitars themselves.

One drawback of modern musical instruments is the static nature of the structure of the instrument. Traditionally, if a musician purchased, for example, a violin having a particular timbre or tonal quality, the sound, looks and ergonomics of that violin could not be changed. The sound of the violin would be dictated primarily by the structural characteristics of the violin, which would remain static and unchanged. If the musician ultimately became bored or disenchanted with the sound of that particular violin, the musician had no alternative but to purchase another violin. The same can be said for other instruments. This is one reason why so many musicians traditionally have painstakingly taken a vast amount of time when purchasing a new instrument. A musician has had to make sure that he or she is completely happy with the sound of that instrument, be it a violin, piano, guitar, woodwind, horn or other instrument, because once a purchase has been made, the musician has been "stuck" with the sound, looks and ergonomics of that instrument.

SUMMARY

Embodiments of the present invention relate to musical instruments having exchangeable components. Embodiments of the present invention allow a musician to alter the tonal qualities, looks and ergonomics of a musical instrument simply by exchanging one or more components of the instrument with other components. Embodiments of the present invention also allow a musician to alter the aesthetic elements of a musical instrument simply by exchanging one or more components of the instrument with other components. Embodiments of the present invention also allow a musician to alter the tonal qualities of a musical instrument simply by exchanging one or more electrical or electronic components of the instrument with other electrical or electronic components.

According to an embodiment of the present invention, a musical instrument having exchangeable parts may include a core portion for providing a foundation for the musical instrument and a body portion removably attachable to the core portion. The body portion may include a single component or a plurality of components. The body portion may also include a first section and a second section. The first section may include a first channel and the second section may include a second channel. Ribs may be disposed within the first channel and the second channel. The ribs may be exposed externally to the musical instrument.

According to another embodiment of the present invention, the core portion may be formed from a single component or from a plurality of components. The core portion may include electronics. The body portion may be removably attached to the core portion with fasteners.

According to another embodiment of the present invention, the body portion may be solid, hollow or semi-hollow. In addition, the body portion may be open-ended or closed-ended. The body portion may be made of wood, metal, plastic, carbon fiber or a composite material. In addition, the core portion may be made of wood, metal, plastic, carbon fiber or a composite material According to another embodiment of the present invention, the musical instrument may be a stringed instrument, such as, for example, a guitar. In addition, the musical instrument may be a woodwind, a horn or a percussion instrument.

According to another embodiment of the present invention, a body portion of the musical instrument may be a body of a guitar. In addition, the core portion may be a neck of a guitar.

According to another embodiment of the present invention, a guitar may include a neck portion and a body portion, wherein the body portion is removably attachable to the neck portion. The body portion may include a single component or comprise a plurality of components. In addition, the body portion may include a first section and a second section. The body portion may be removably attached to the neck portion.

According to another embodiment of the present invention, a method of making a musical instrument having exchangeable components may include providing a core portion for structurally supporting the musical instrument;

providing a body portion, the body portion being removably attachable to the core portion; and attaching the body portion to the core portion.

DETAILED DESCRIPTION

In the following description of preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the preferred embodiments of the present invention.

Although the following description is directed primarily to a stringed musical instrument, such as, for example, a six string guitar, it is to be understood that embodiments of the present invention may be adapted to any musical instrument. For example, other types of guitars rather than a six string guitar may be adapted to embodiments of the present invention, such as, for example, 7-string guitars, 8-string guitars, 10-string guitars, twelve string guitars, tenor guitars, four string bass guitars, 5-string string bass guitars, 6-string bass guitars and the like. In addition, other stringed musical instruments may also be adapted to embodiments of the present invention, such as, for example, banjos, ukuleles, mandolins and the like, as well as the traditional orchestral stringed musical instruments, such as, for example, violins, violas, cellos and contrabasses.

Embodiments of the present invention are not limited to stringed musical instruments, however. Embodiments of the present invention may also be adapted to woodwind instruments, such as, for example, piccolos, flutes, oboes, clarinets, recorders and bassoons, and the like, and horn instruments, such as, for example, trumpets, French horns, trombones, tubas, saxophones, and the like. Embodiments of the present invention may also be adapted to percussion instruments, such as for example, marimbas, vibraphones, drums, symbols, timpani, glockenspiel, woodblock, chimes, shakers and the like.

Figure 1:
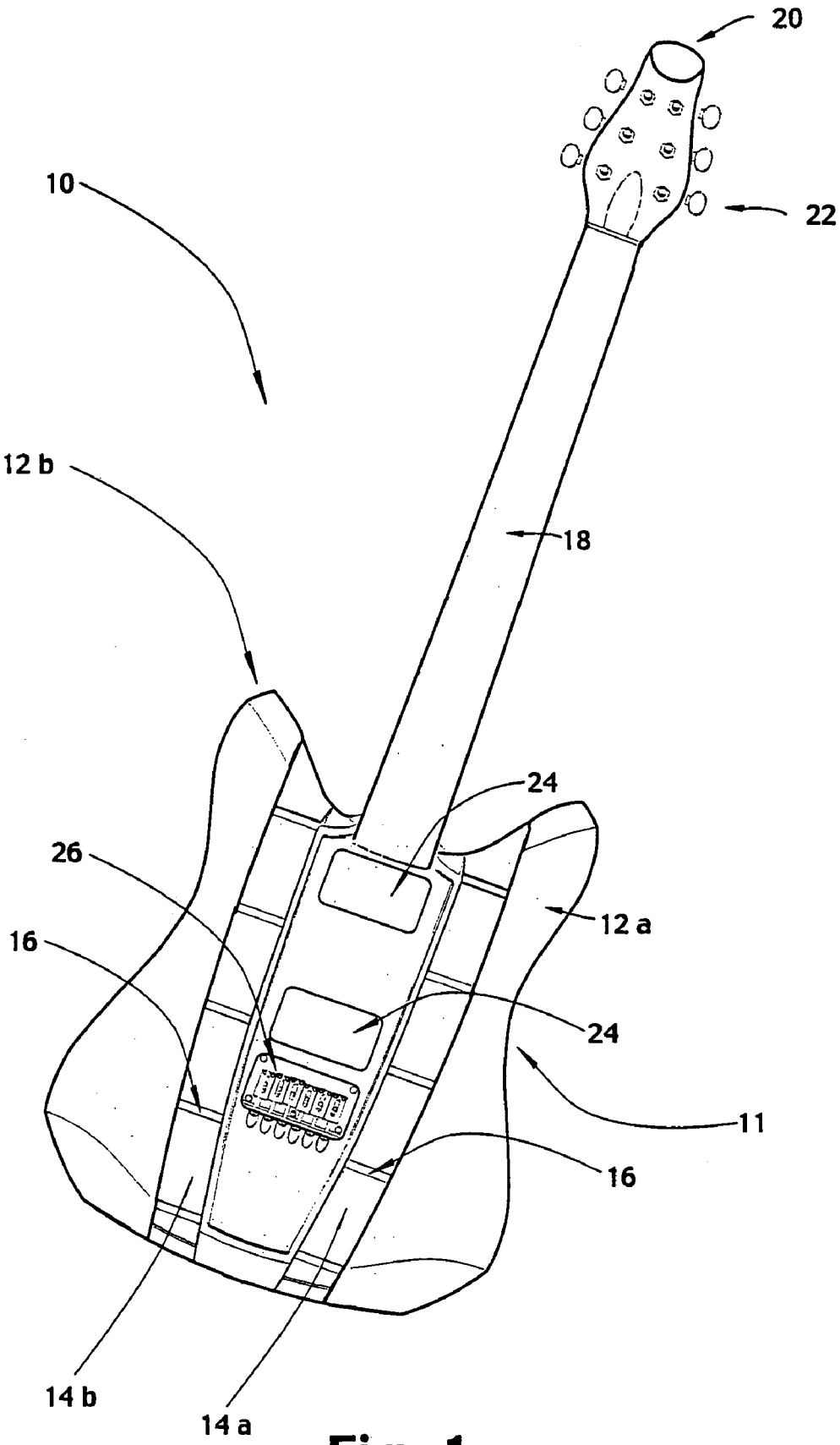
FIG. 1 shows a musical instrument having exchangeable components according to an embodiment of the present invention.
Figure 2:
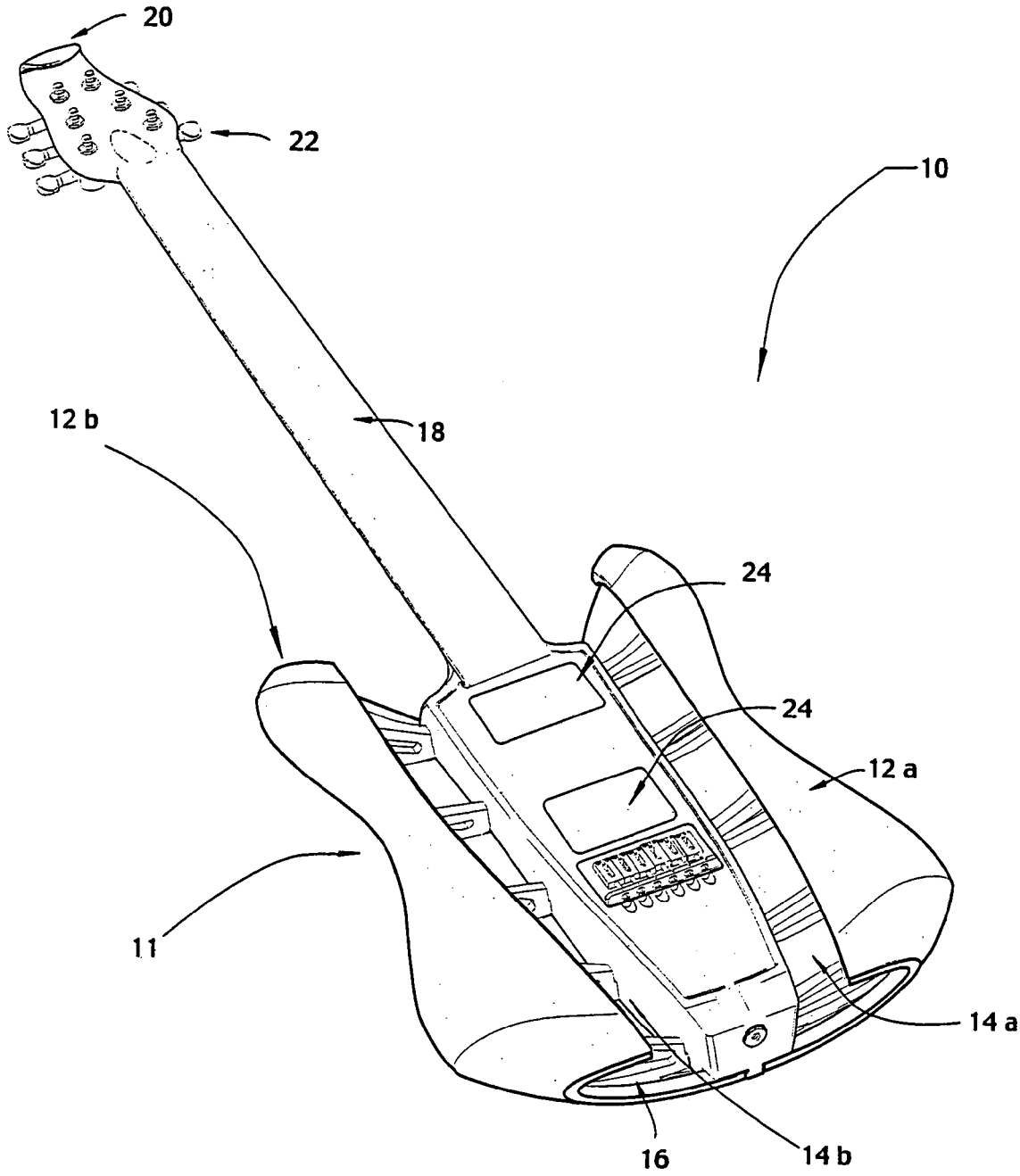
FIG. 2 shows a perspective view of a musical instrument having exchangeable components according to an embodiment of the present invention.

A musical instrument having exchangeable components 10 according to an embodiment of the present invention is shown generally in FIG. 1. A perspective view of the musical instrument having exchangeable components 10 according to an embodiment of the present invention is shown in FIG. 2. The musical instrument having exchangeable components 10 shown in FIG. 1 is a guitar and may include, for example, a core portion 18 and a body portion 11, the body portion 11 having a first body section 12*a* and a second body section 12*b*. The first body section 12*a* and the second body section 12*b* may be removably attached to the core portion 18 using one or more removable fasteners, such as, for example, screws.

The body portion 11 may take a variety of shapes and sizes. The body portion 11 may be formed as a single component or may be formed as two or more components. According to an embodiment of the present invention, a plurality of body sections forming a body portion may be removably attached to one or more core portions to form a musical instrument. In the embodiment of the present invention shown in FIG. 1, the body portion 11 is formed from two separate pieces, first body section 12*a* and second body section 12*b*, which are removably attached to the core portion 18.

The first body section 12*a* and the second body section 12*b* may be contoured in a variety of ways. The contour of the first body section 12*a* and the second body section 12*b* may be dictated by a timbre or tonal characteristics desired by the user, or may be dictated by appearances or ergonomics desired by the user. For example, the contour of the first body section 12*a* and the second body section 12*b* may be formed to enhance or attenuate one or more frequency bands capable of being produced by the guitar. The contour of the first body section 12*a* and the second body section 12*b* may be formed to attenuate higher frequencies and enhance lower frequencies, for example, or may be formed to enhance higher frequencies and attenuate lower frequencies.

The first body section 12*a* and the second body section 12*b* may be designed to achieve a wide variety of voices. For example, according to an embodiment of the present invention, the first body section 12*a* and the second body section 12*b* may be designed to form a hollow sound chamber, similar to those found in acoustic guitars. The hollow sound chamber may be the result of two hollow pieces joined together or, in an alternative embodiment, may be formed from a single hollow piece which attaches to the core portion.

According to another embodiment of the present invention, the first body section 12*a* and the second body section 12*b* may be designed to form a semi-hollow sound chamber, similar to those found in electric-acoustic guitars or semi-hollow body electric guitars. The semi-hollow sound chamber may be the result of two semi-hollow pieces joined together or, in an alternative embodiment, may be formed from a single semi-hollow piece which attaches to the core portion.

According to another embodiment of the present invention, the body portion 11 may be designed to accommodate electrical or electronic components, such as, for example, pickups, transducers, switches, controls, lights and the like. The electrical or electronic components may be stand-alone within the body portion or may be integrated into the body portion 11 in such a way that they interface with one or more components located on the core portion 18. For example, additional pickups having unique tonal characteristics may be integrated into the body portion 11 and may interface to pickup electronics located on or within the core portion 18.

In addition, the first body section 12*a* and the second body section 12*b* may be formed simply for aesthetic purposes, for looks or appearances, or for ergonomics. The first body section 12*a* and the second body section 12*b* may be formed in a more traditional manner or may be formed in a manner highly unusual for the instrument.

In the embodiment of the present invention shown in FIG. 1, the first body section 12*a* may include a first channel 14*a* and the second body section 12*b* may include a second channel 14*b*. The first and second channels 14*a*, 14*b* provide, inter alia, unique resonant characteristics for the first and second body sections 12*a*, 12*b* which, in turn, provide unique vibrating characteristics to the strings (not shown) of the guitar. The unique vibrating characteristic of the strings can then be sensed by pickups on the guitar, which can then send a signal representing the unique vibrating characteristics of the strings to an amplifier to produce an audible sound having unique tonal qualities. In addition, the first and second channels 14*a*, 14*b* provide, inter alia, an area in which to place or insert one or more ribs 16 or other resonance enhancing or resonance altering structures. The ribs 16 may transfer vibration within the first body section 12*a* and the second body section 12*b* in a unique way, thus resulting in unique tonal characteristics for the instrument. According to an embodiment of the present invention, the first body section 12*a* and the second body section 12*b* may attach to the core portion 18 using fasteners that extend through the ribs 16.

According to embodiments of the present invention, the core portion 18 may be formed in a variety of ways. For example, the core portion 18 may be a single part or may be formed from a plurality of parts joined together. For example, in the embodiment shown in FIG. 1, the core portion 18 is a guitar neck that may be a single piece carved from wood, a portion of which is surrounded by the first body section 12*a* and the second body section 12*b*. Alternatively, the core portion 18 may be a guitar neck formed from two or more separate and distinct pieces. For example, the core portion 18 may be a guitar neck and body piece formed from a neck having frets and fret wires and a body accommodating pickups and other electronics. The core portion 18 may also include a head stock 20 and tuning pegs 22 at a first end of the core portion and pickups 24 and a bridge 26 at a second end of the core portion.

Other items peculiar to a particular instrument may also be included with the core portion 18. For example, if the core portion 18 is a guitar neck and body piece, the core portion may include tone controls, volume controls, pickup selector switches, a cord socket, battery compartments, and the like. Also, if the core portion 18 is a guitar neck and body piece, the guitar neck may include a fretboard and fret wires, a headstock with tuning machines, and a section for pickups and other electronics.

Figure 3:
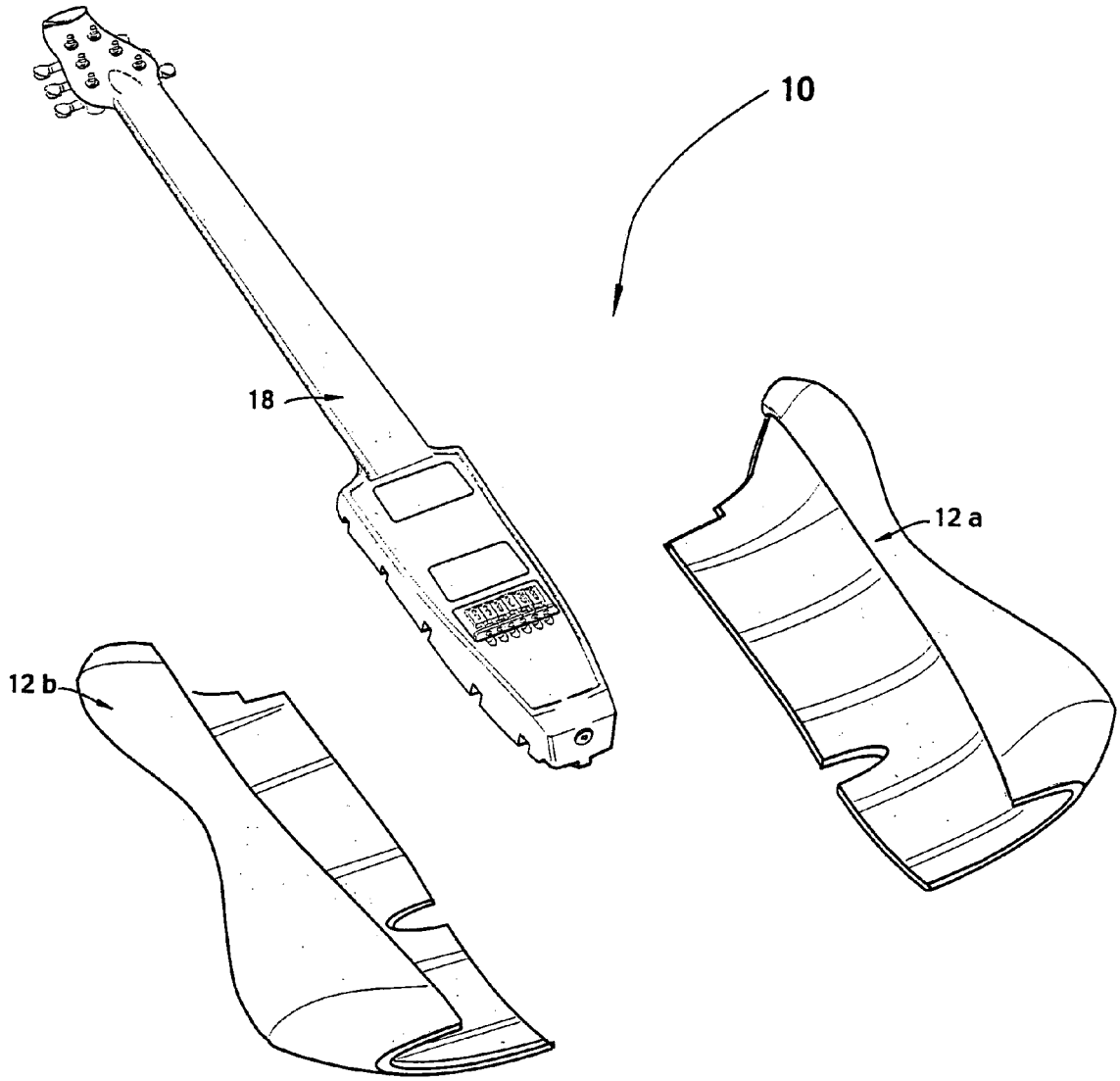
FIG. 3 shows an exploded view of a musical instrument having exchangeable components according to an embodiment of the present invention.

An exploded view of a musical instrument having exchangeable components 10 according to an embodiment of the present invention is shown in FIG. 3. The first body section 12*a* and the second body section 12*b* are formed as two distinct parts that may attach to, or be annexed to, the core portion 18. According to the embodiment of the present invention shown in FIG. 3, the core portion 18 is a single part to which the first body section 12*a* and the second body section 12*b* to form a musical instrument having unique tonal characteristics and a unique voice.

Figure 4:
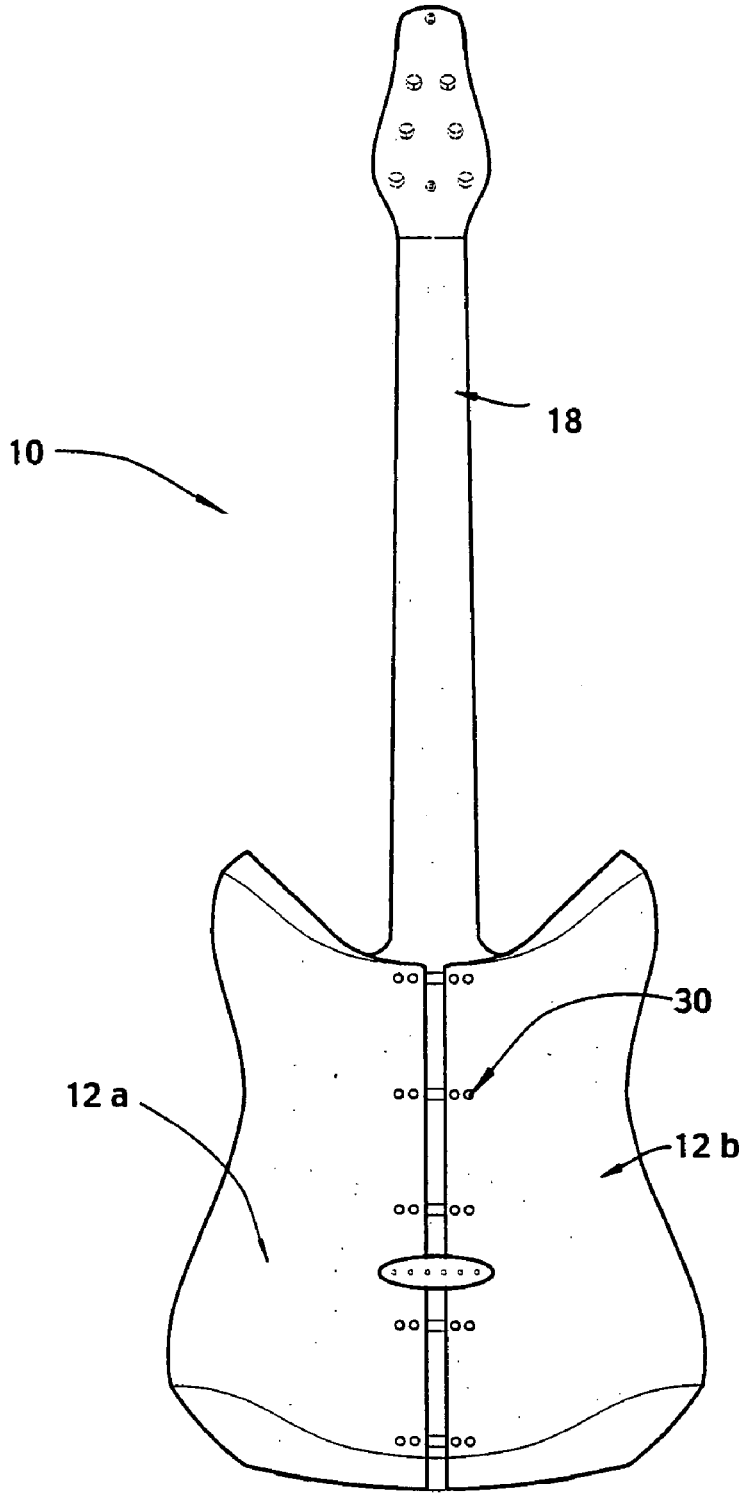
FIG. 4 shows a first body section and the second body section attached to a core portion according to an embodiment of the present invention.

The first body section. 12*a* and the second body section 12*b* may attach to the core portion 18 in a variety of ways. A method of attaching the first body section 12*a* and the second body section 12*b* to the core portion 18 according to an embodiment of the present invention may be seen in FIG. 4. The first body section 12*a* and the second body section 12*b* may be provided with attachment points 30 through which fasteners, such as screws, for example, may be extended to arrive at an anchoring point on the core portion 18. If desirable, the fasteners may also extend through the ribs 16 prior to arriving at an anchoring point on the core portion 18.

Figure 5:
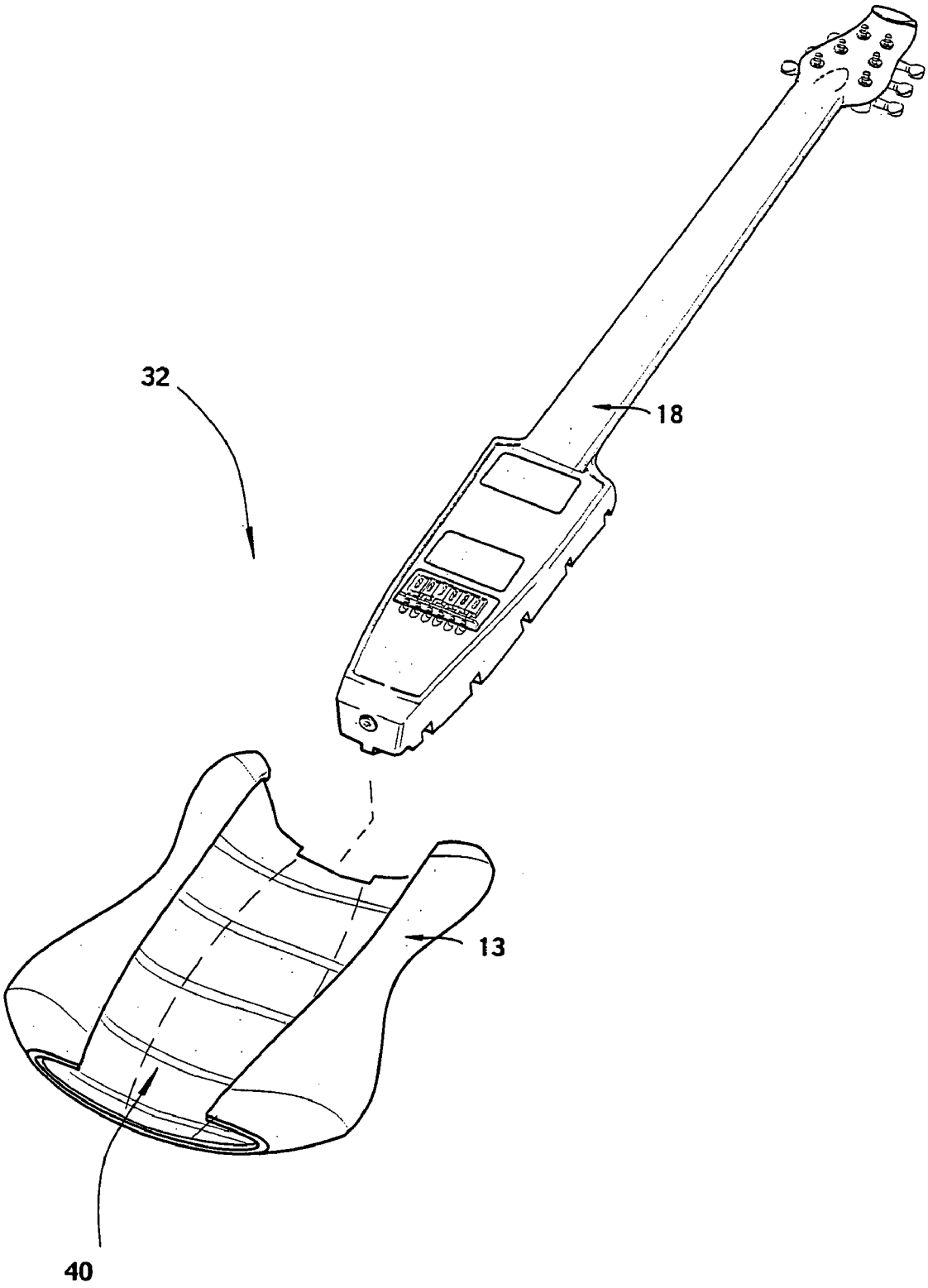
FIG. 5 shows a musical instrument having exchangeable components having a body portion formed as a single component according to an embodiment of the present invention.

A musical instrument having exchangeable components 32 according to an embodiment of the present invention in which the body portion 13 is formed as a single component is shown in FIG. 5. In FIG. 5, the core portion 18 may be placed into a positioning area 40 existing within the body portion 13. The core portion 18 may attach to the body portion 13 in a variety of ways, such as, for example, using fasteners as was shown in FIG. 4.

Figure 6:
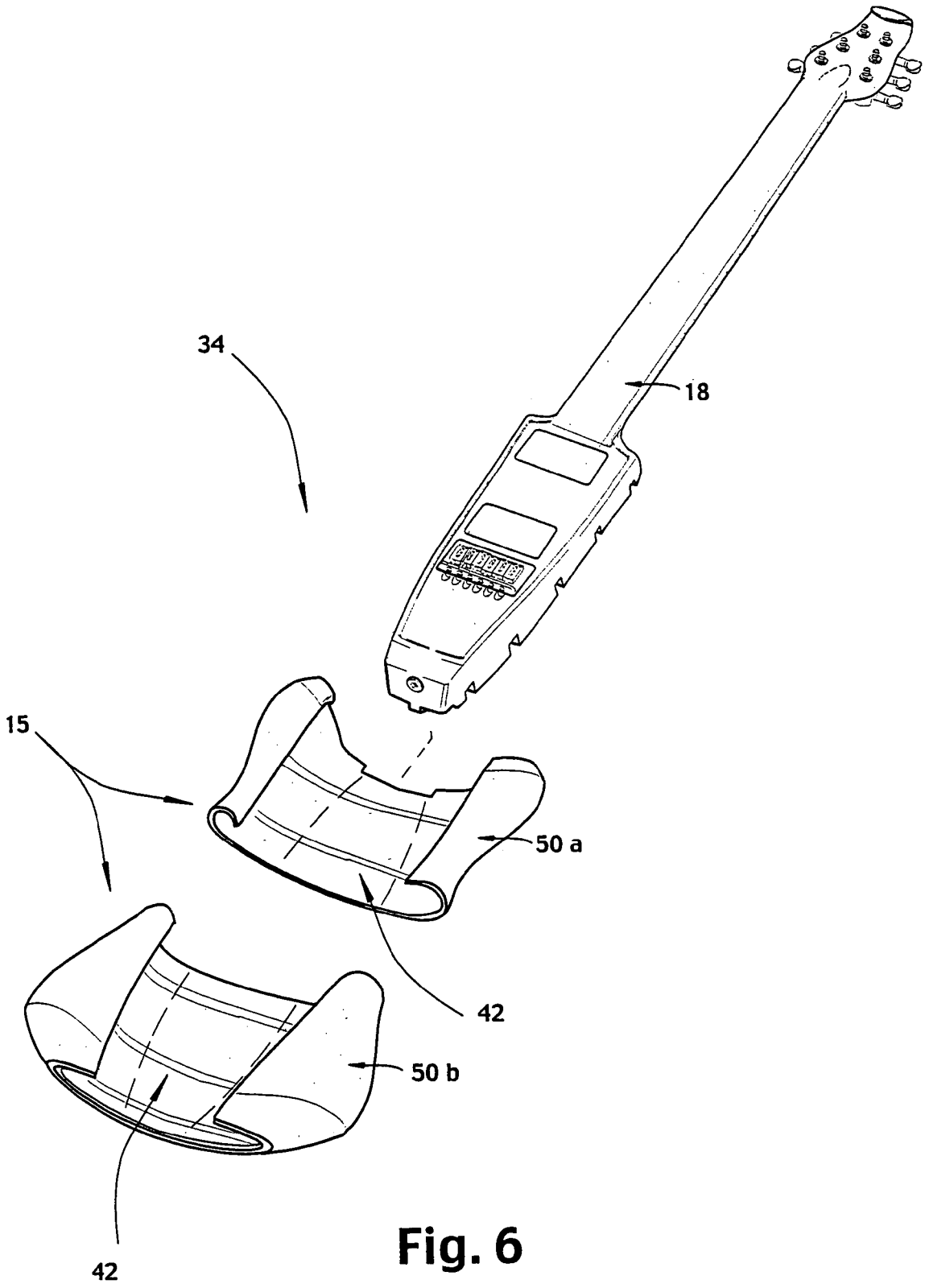
FIG. 6 shows a musical instrument having exchangeable components having a body portion formed from a first body section and a second body section according to another embodiment of the present invention.

A musical instrument having exchangeable components 34 according to another embodiment of the present invention in which a body portion 15 is formed from a first body section 50*a* and a second body section 50*b* is shown in FIG. 6. In FIG. 6, the core portion 18 may be placed into a positioning area 42 existing within the first body section 50*a* and the second body section 50*b*. The core portion 18 may attach to the body portion 15 in a variety of ways, such as, for example, using fasteners as was shown in FIG. 4.

Figure 7:
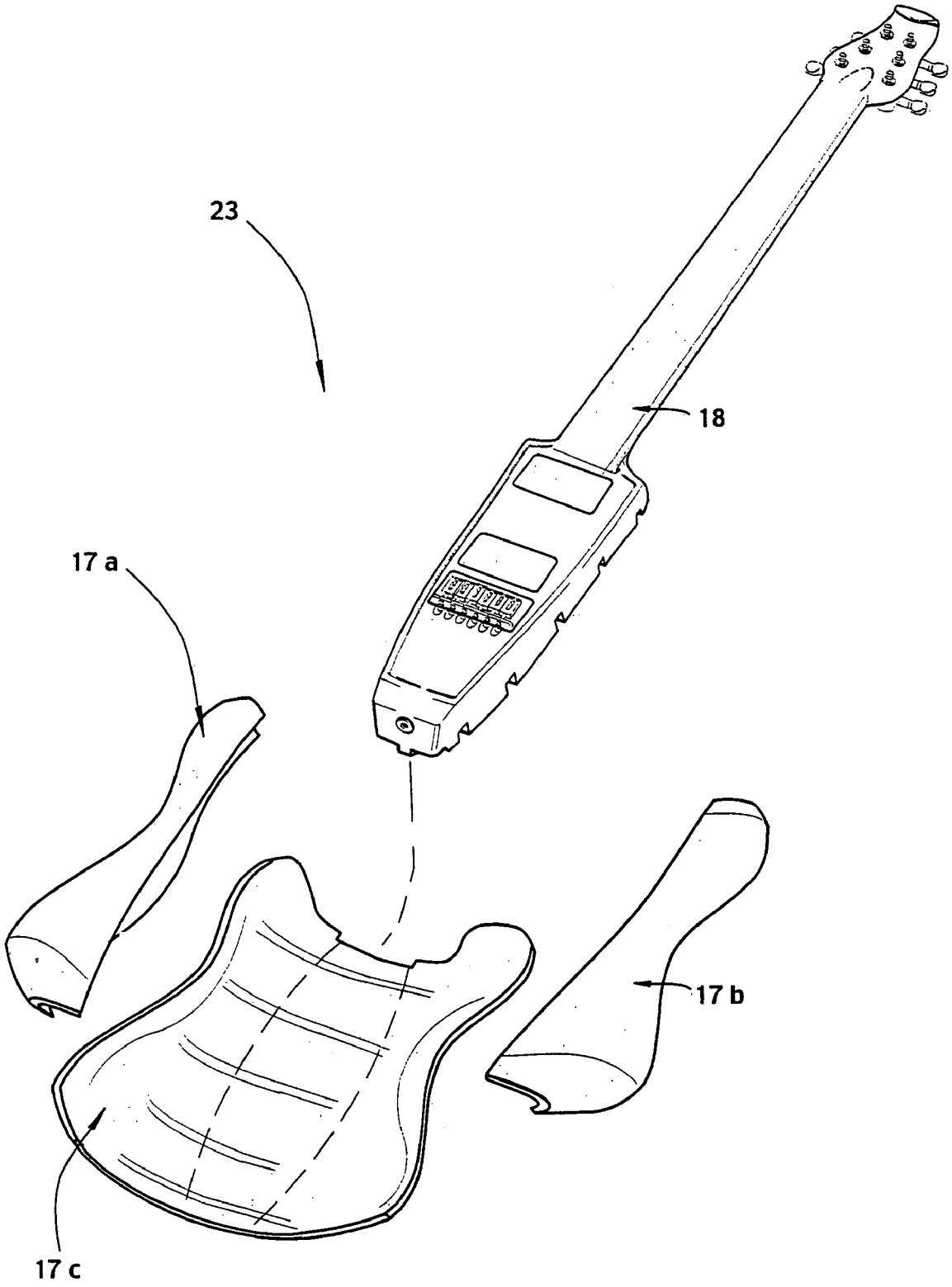
FIG. 7 shows a musical instrument having exchangeable components having a body portion formed from a first body section, a second body section and a third body section according to another embodiment of the present invention.

A musical instrument having exchangeable components 23 according to another embodiment of the present invention in which a body portion is formed from a first body section 17*a*, a second body section 17*b* and a third body section 17*c* is shown in FIG. 7. In FIG. 7, the first body section 17*a*, the second body section 17*b* and the third body section 17*c* may attach to the core portion 18 in a variety of ways, such as, for example, using fasteners as was shown in FIG. 4.

Figure 8:
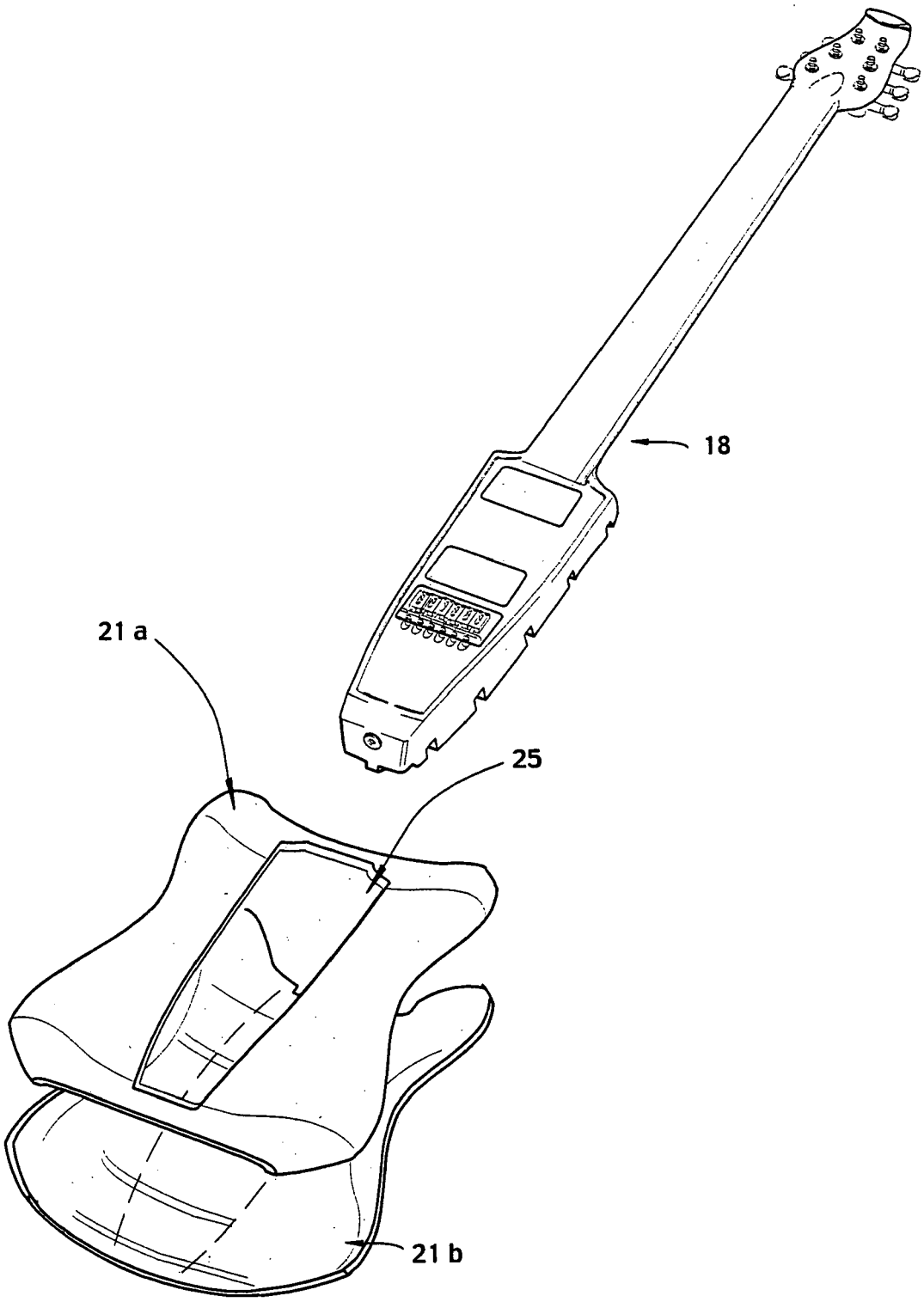
FIG. 8 shows a musical instrument having exchangeable components having a body portion formed from a first body section and a second body section according to another embodiment of the present invention.

A body portion having a first body section 21*a* and a second body section 21*b* is shown in FIG. 8. In FIG. 8, the first body section 21*a* and/or the second body section 21*b* may include an area 25 into which a core portion may be received. In the embodiment of the invention shown in FIG.

8, the first body section 21*a* and the second body section 21*b* form a "clam shell" around a core portion. The first body section 21*a* and the second body section 21*b* may attach to a core portion in a variety of ways, such as, for example, using fasteners as was shown in FIG. 4.

Figure 9:
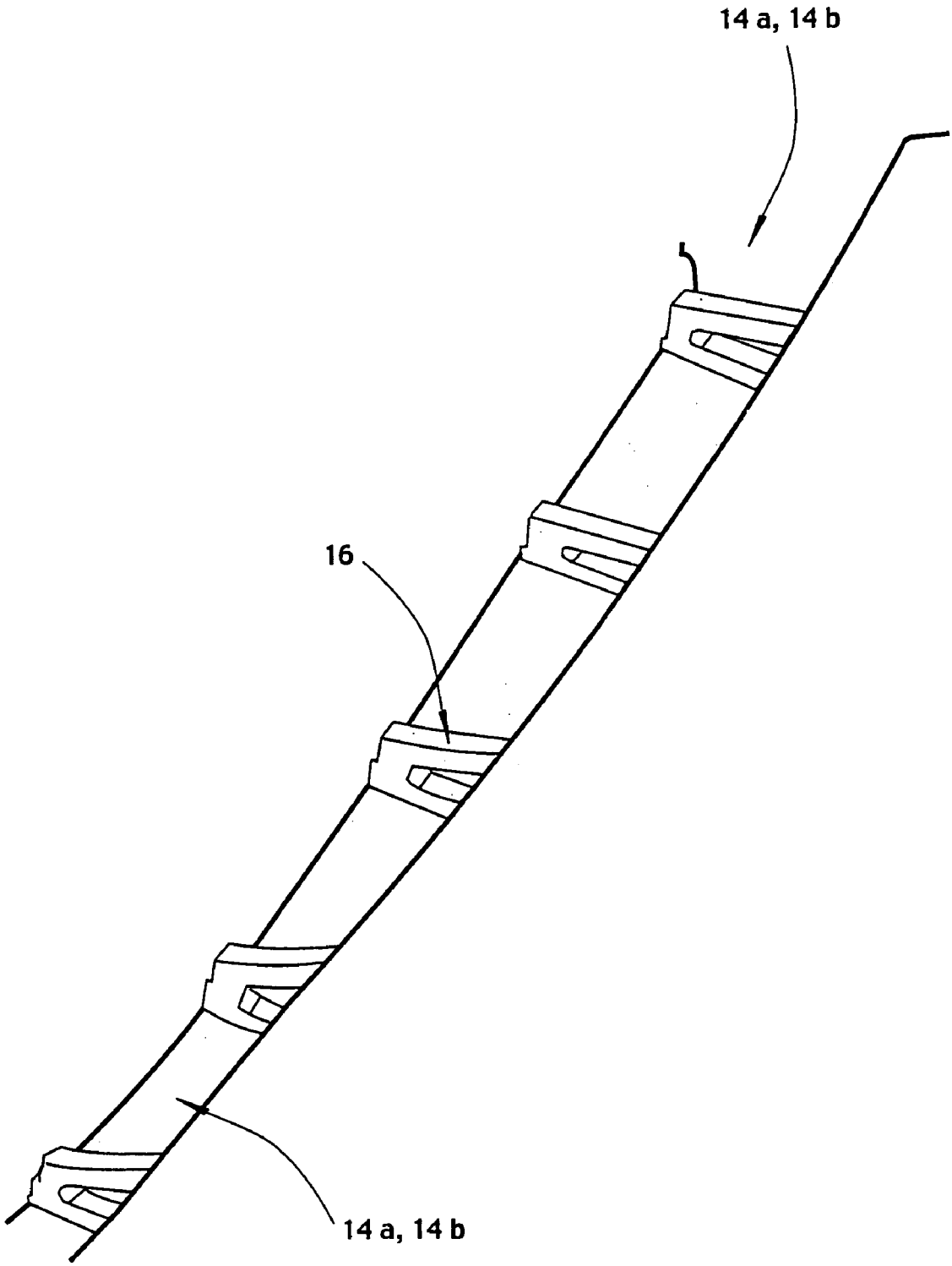
FIG. 9 shows an enhanced view of ribs that may be placed into first and second channels of a body portion according to an embodiment of the present invention.

An enhanced view of the ribs 16 that may be placed into the first and second channels 14*a*, 14*b* according to an embodiment of the present invention is shown in FIG. 9. The ribs 16 may be designed for a variety of reasons and may take a variety of forms in addition to the form of the ribs shown in FIG. 6. For example, according to an embodiment of the present invention, the ribs 16 may be designed to provide resonance altering or resonance enhancing characteristics of the guitar. According to another embodiment of the present invention, the ribs 16 may be designed to provide structural support for the first body section 12*a* and the second body section 12*b*. In yet another embodiment of the present invention, the ribs 16 may be designed for aesthetic or visual impact.

Figure 10:
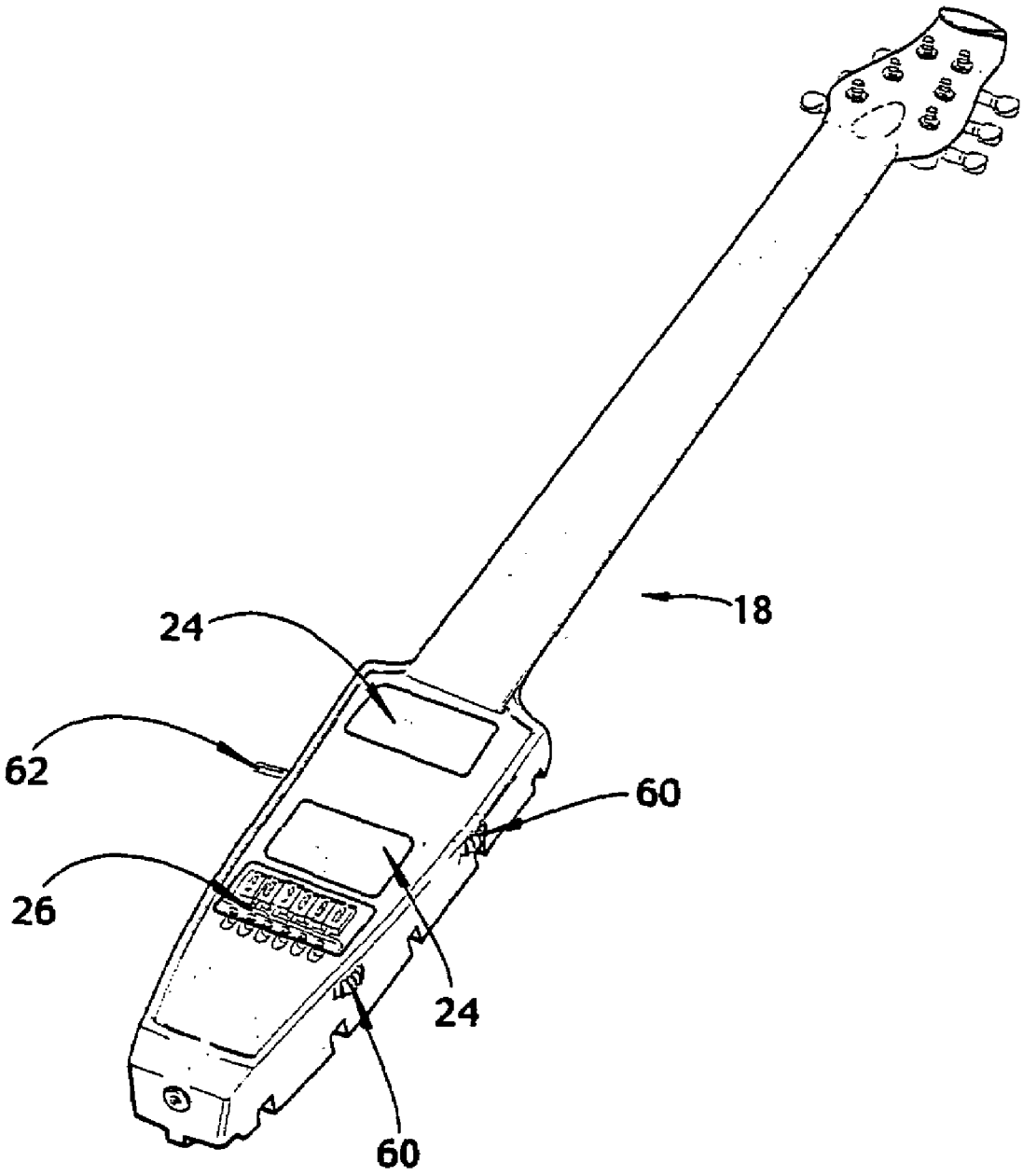
FIG. 10 shows an isolated view of a core portion according to an embodiment of the present invention.

An isolated view of a core portion 18 according to an embodiment of the present invention is shown in FIG. 10. In the embodiment shown in FIG. 10, the core portion 18 is a guitar neck. The core portion 18 according to the embodiment shown in FIG. 10 includes, but is not limited to, a bridge 26 to which strings (not shown) may be attached and pickups 24 for sensing the vibration of the strings. The core portion 18 shown in FIG. 10 also includes, but is not limited to, controls 60 for adjusting parameters, such as, for example, tone and volume, and a selector switch 62 for selecting a pickup 24. In the embodiment shown in FIG. 10, the core portion 18 is a single component. However, according to other embodiments of the invention, the core portion 18 may be a plurality of sections attached together to form one component.

The core portion 18 shown in the embodiment in FIG. 10 may include a plurality of pickups or, if, according to an embodiment of the present invention, the core portion 18 is the neck of an acoustic guitar, it may have no pickups. Moreover, all of the electronics and mechanical components included with the core portion 18 may be designed to be removably attached to the core portion 18 in a fashion similar to the removably attachable body portion. Thus, in addition to modifying the timbre or tonal characteristics of the instrument by exchanging body portions, a musician may also adjust the timbre or tonal characteristics of the instrument by exchanging electronic components. In addition, mechanical components such as, for example, the controls 60 and selector switch 62 may be designed to be exchanged onto different portions of the core portion 18. Thus, for example, if a musician did not like the position placement of the controls 60 and selector switch 62 on the core portion 18 as shown in FIG. 10, the musician could remove the controls 60 and selector switch 62 on the core portion 18 as shown in FIG. 10 and exchange them for controls and a selector switch that are locatable in a different position on the core portion 18. The musician could also remove the controls 60 and selector switch 62 on the core portion 18 and exchange them for controls and a selector switch that has a feel or look more to the musician's liking, if so desired.

Figure 11:
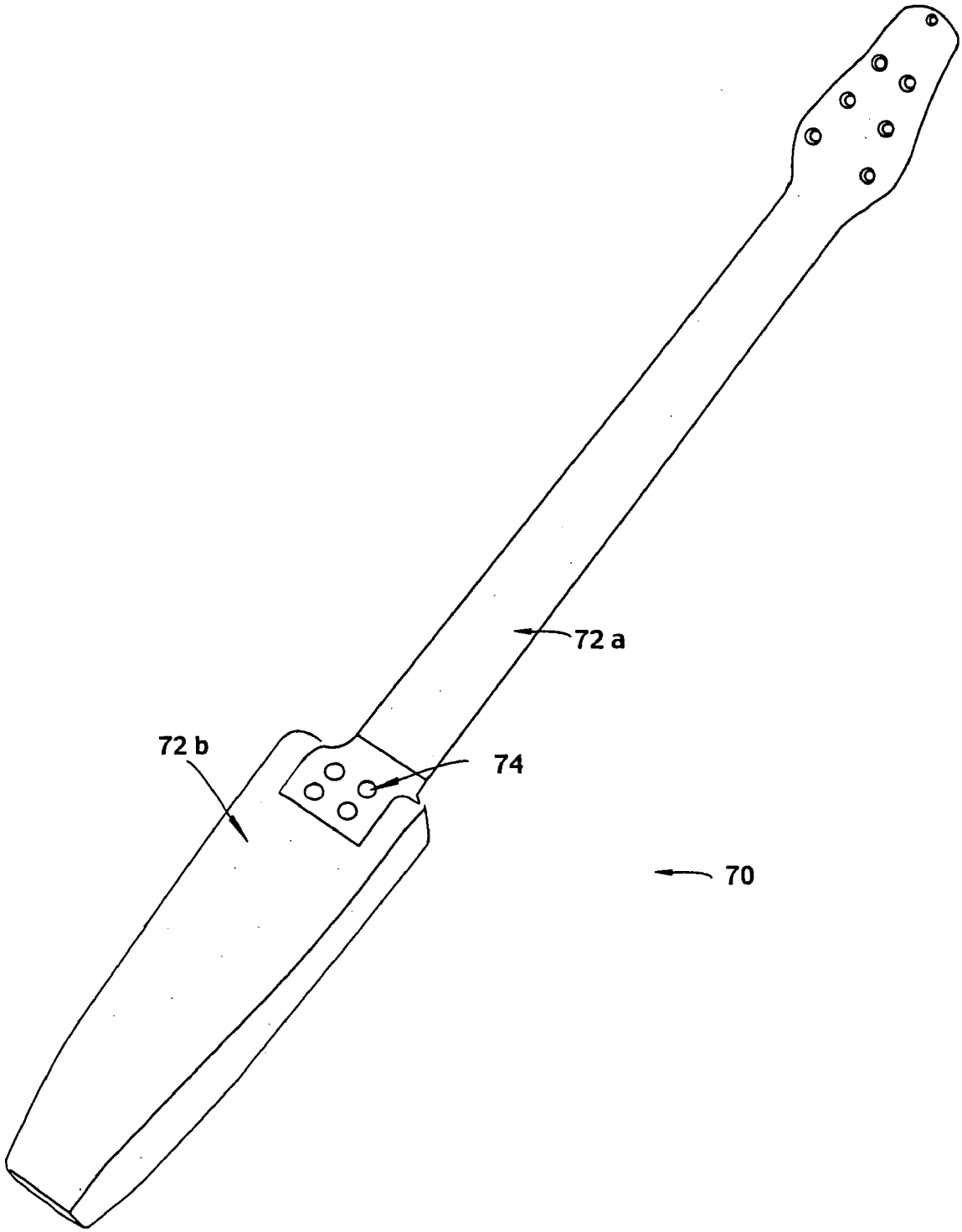
FIG. 11 shows an isolated view of a core portion according to another embodiment of the present invention.

An isolated view of a core portion 70 according to another embodiment of the present invention is shown in FIG. 11. In the embodiment shown in FIG. 11, the core portion 70 is a guitar neck. In addition, the core portion 70 shown in the embodiment of FIG. 11 is formed from a first core section 72*a* and a second core section 72*b*. The first core section 72*a* is removably attached to the second core section 72*b* by one or more fasteners 74. The fasteners 74 may be any of a variety of fasteners common in the industry, such as, for example, screws.

According to the embodiment of the present invention shown in FIG. 11, a musician who is happy with the timbre or tonal characteristics of a particular body portion but would like to change the timbre or feel of the core portion 70 could exchange the first core section 72*a* with another first core section.

Figure 12:
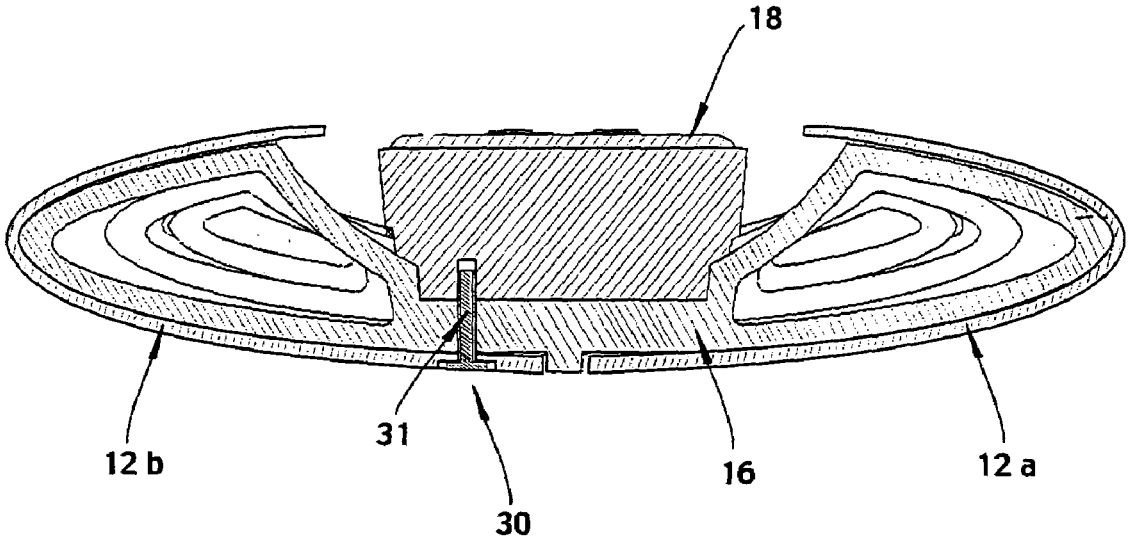
FIG. 12 shows a cross-sectional view through a rib of an embodiment of the present invention shown in FIG. 1.

FIG. 12 shows a cross-sectional view through a rib 16 of an embodiment of the present invention shown in FIG. 1. In FIG. 12, the first body section 12*a* and the second body section 12*b* attach to the core portion 18 through attachment points 30 using fasteners 31. It can readily be seen in FIG. 12 that the first body section 12*a* and the second body section 12*b* are "open ended." In addition, in the embodiment of the invention shown in FIG. 12, the first body section 12*a* and the second body section 12*b* are of a thin wall construction, thus rendering the entire body area substantially hollow except in the area of the ribs 16.

Figure 13:
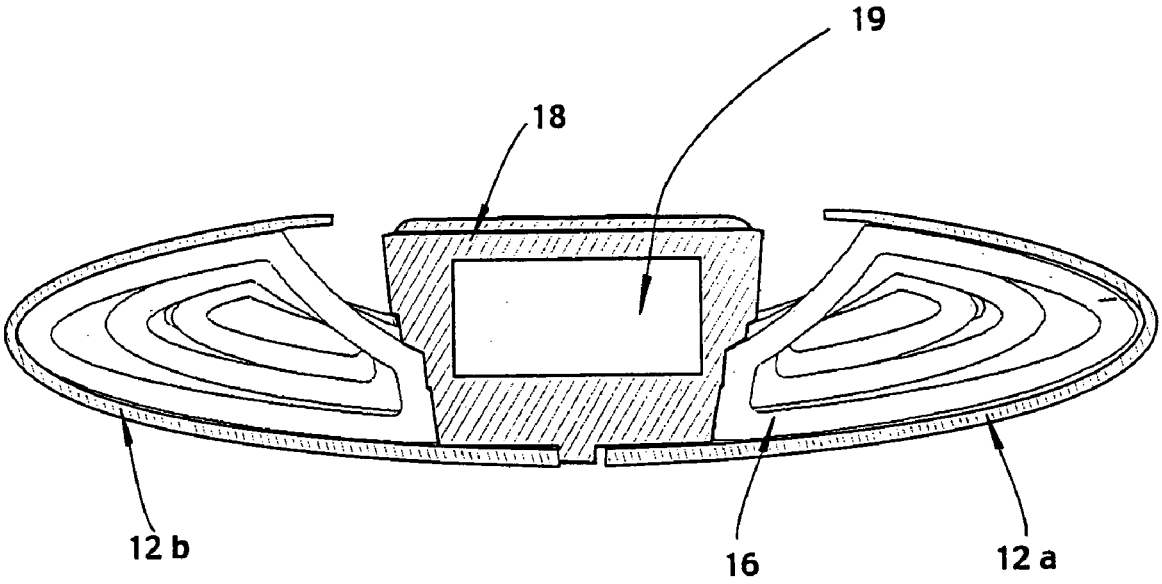
FIG. 13 shows another cross-sectional view adjacent a rib of an embodiment of the present invention shown in FIG. 1.

FIG. 13 shows another cross-sectional view adjacent a rib 16 of an embodiment of the present invention shown in FIG. 1. In FIG. 13, a portion of the core has a hollow area 19 that may be used to house electronics or other items desired by the musician for use of the instrument.

Referring back to FIG. 1, according to an embodiment of the present invention, the body portion II may be made from a variety of materials. For example, the body portion 11, may be made from wood, metal, plastic, carbon fiber, a composite material and the like. In addition, the body portion 11 may be made from a combination of materials. For example, various parts of a body portion 11 formed as a single component may be made from different materials. According to another embodiment of the present invention, different sections of a body portion may be made from different materials. For example, the first body section 12*a* may be made from one material, such as carbon fiber, and the second body section 12*b* may be made from another material, such as a composite.

In addition, other components of a musical instrument having exchangeable components 10 may also be made from a variety of materials. For example, the core portion 18 and the ribs 16 may be made from wood, metal, plastic, carbon fiber, a composite material and the like, or a combination of materials. According to an embodiment of the present invention, if the core portion 18 is a guitar neck, the core portion 18 may be made from woods such as maple, rosewood, ebony or a combination of these woods.

Figure 14:
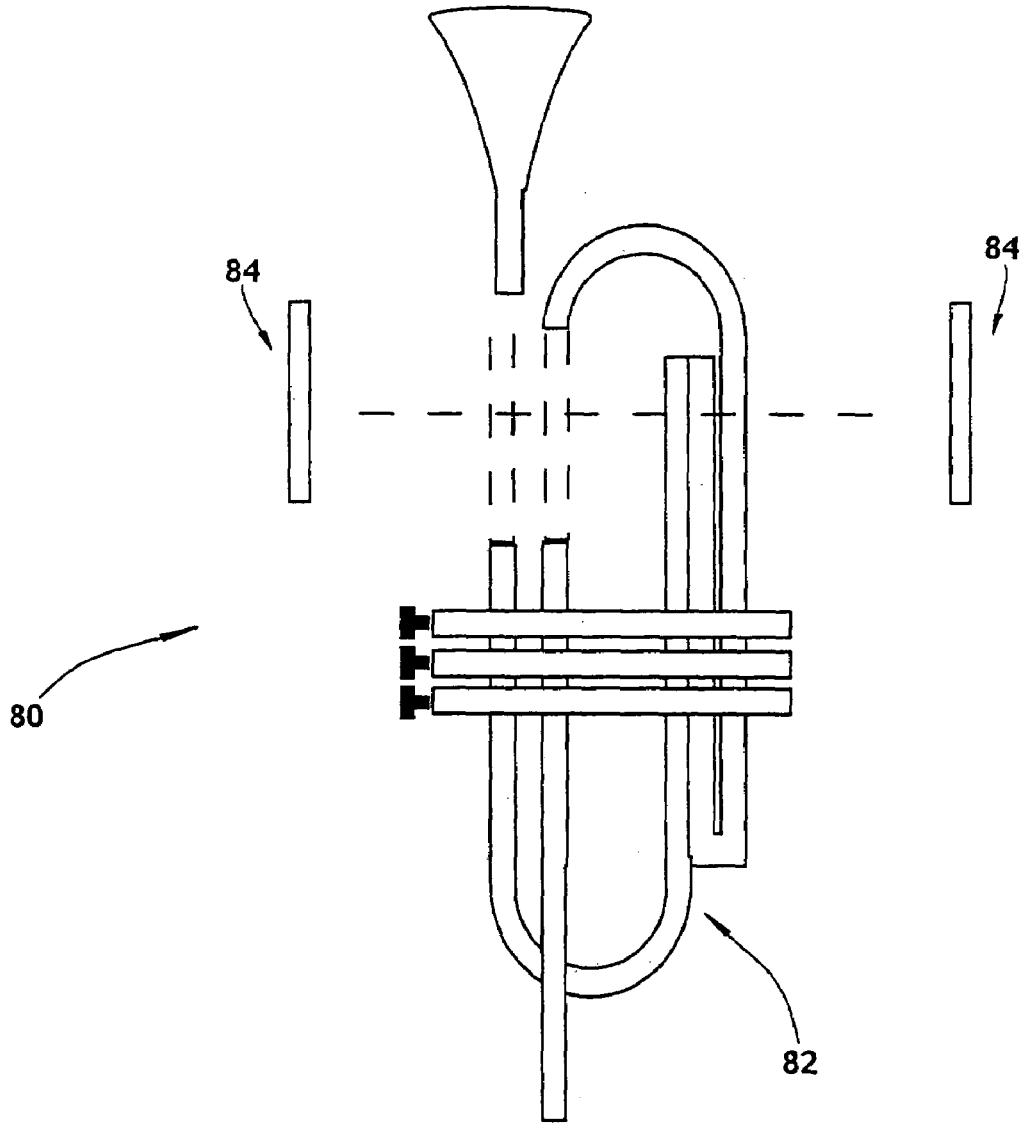
FIG. 14 shows a musical instrument having exchangeable components according to another embodiment of the present invention.
Figure 15:
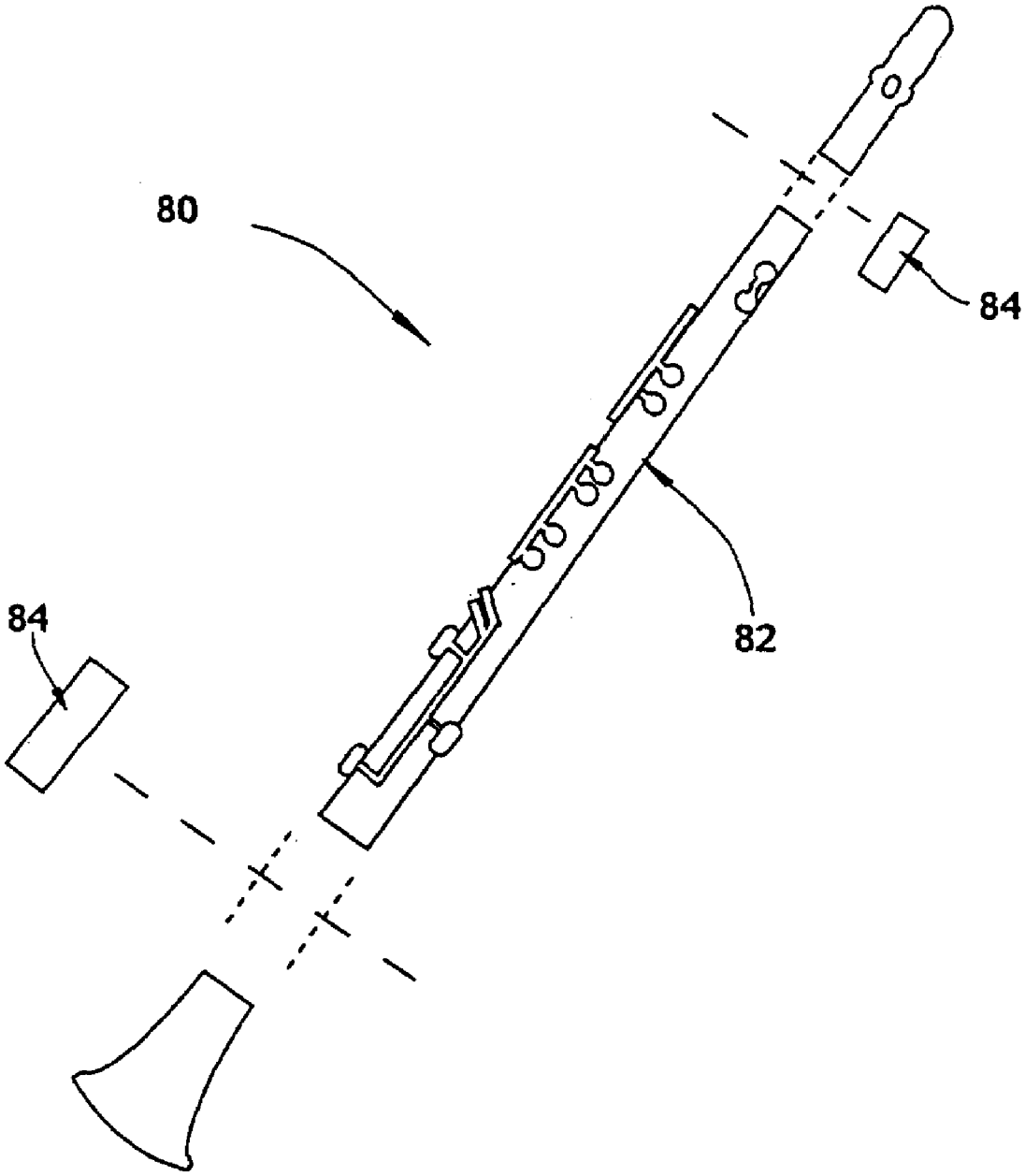
FIG. 15 shows a first body portion and the second body portion attached to a core portion according to an embodiment of the present invention.
Figure 16:
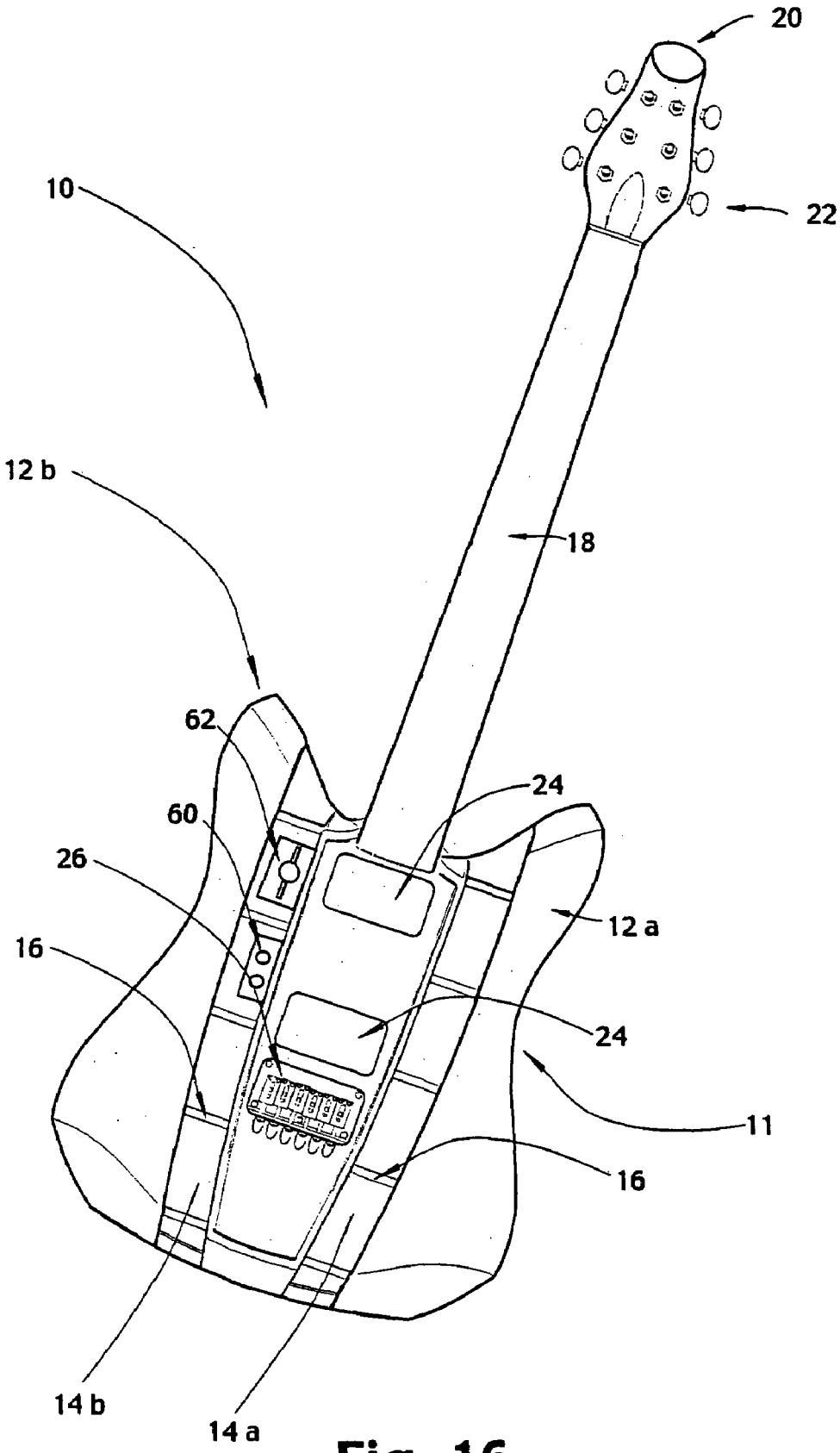
FIG. 16 shows a musical instrument having exchangeable components according to an embodiment of the present invention, and further shows the inclusion of controls and a selector switch.
Figure 17:
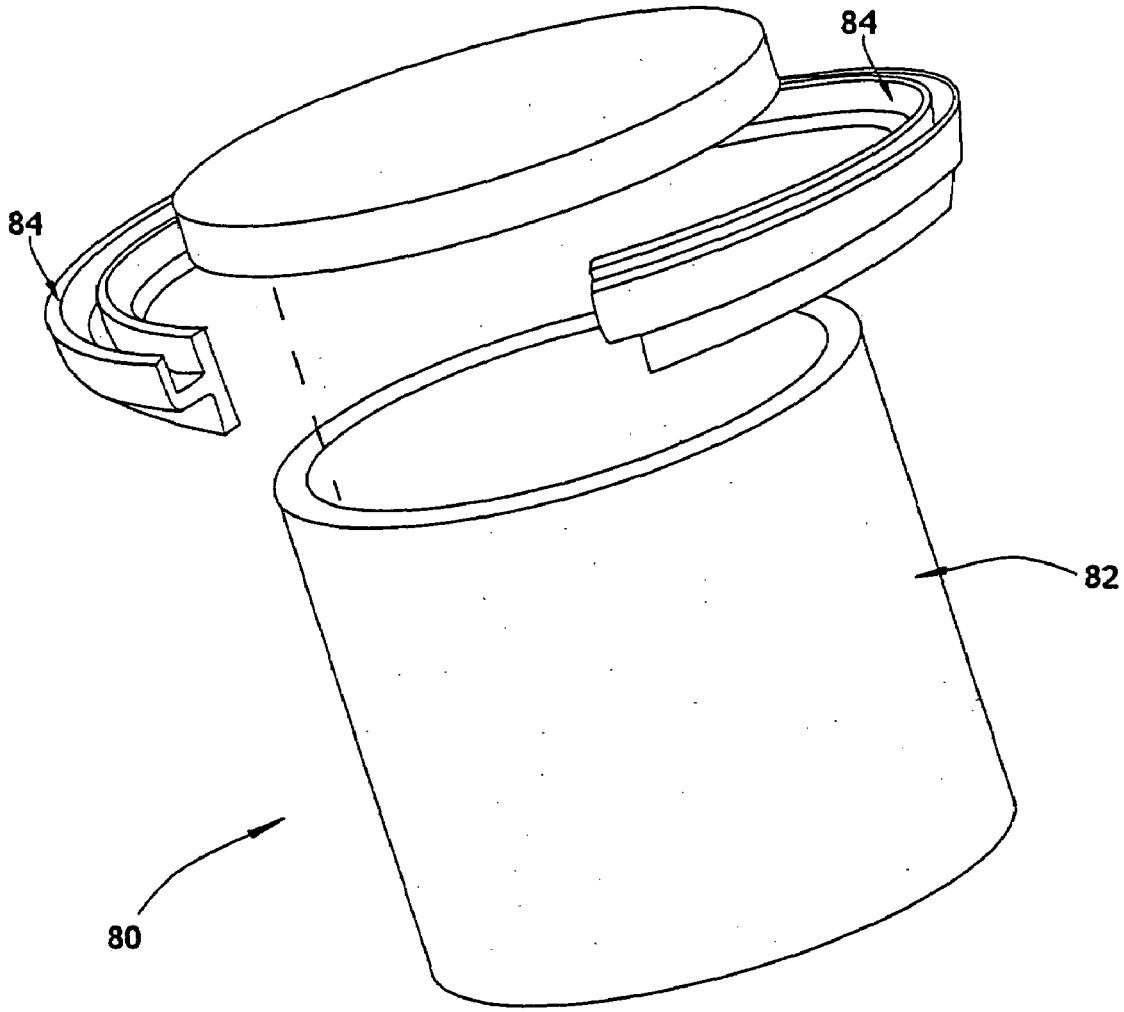
FIG. 17 shows a body portion attached to a core portion according to an embodiment of the present invention.

A musical instrument having exchangeable components 80 according to another embodiment of the present invention having a core portion 82 and a body portion 84 is shown in FIG. 14. In the embodiment shown in FIG. 14, the musical instrument is a trumpet. The body portion 84 may be removably attached to the core portion 82, thereby allowing a musician to change the timbre or tonal characteristics of the instrument simply by exchanging body portion 84 for another body portion 84. In the embodiment shown in FIG. 14, the body portion 84 includes two separate components; however, according to embodiments of the present invention, the body portion 84 may include one component, two components or a plurality of components.

The advantages of embodiments of the present invention may readily be seen. By having a variety of body portions available, a musician may be able to alter the timbre or tonal characteristics of an instrument simply by removing one or more body portions and exchanging them with others. Thus, rather than having an arsenal of instruments each having a unique timbre or tonal characteristic, a musician may retain one core portion and a plurality of body portions.

Embodiments of the present invention provide numerous advantages over the prior art. For example, guitar players become particularly attached to the feel and playability of the necks of their guitars, i.e., the core portion of their guitar.

Guitar players typically have a "favorite guitar" that always "feels" good to them, thus enhancing their playing and providing for an enhanced musical experience. According to embodiments of the present invention, a guitar player may find a favorite core portion, i.e., a favorite neck, one that agrees with the guitar player from a feel and playability standpoint, and retain that core portion and use it with a plurality of body portions. Thus, a guitar player may change the timbre or tonal characteristics of the guitar without having to lose that "favorite" guitar feel, simply by retaining the core portion of the guitar but exchanging body portions.

Other musicians will find similar advantages with embodiments of the present invention. For example, woodwind and horn players may become particularly fond of a particular embouchure, keys or pads. Using embodiments of the present invention, a woodwind or horn player may retain a core portion, such as, for example, a main sound chamber having keys and a mouthpiece, and exchange various body portions that alter the structural characteristics of the sound chamber to change the timbre of the instrument. Thus, the woodwind or horn player may continue to enjoy the feel of the embouchure, keys or pads, for example, while greatly expanding the tonal characteristics of the instrument.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. A musical instrument comprising:

a core portion formed as a single component, continuous structure providing main core, neck, and headstock portions;

a body portion removably attached to the core portion, the body portion including at least first and second sections that include respective first and second channels; and at least one rib adjacent to and interacting with the body portion, wherein the rib alters the resonant characteristics of the musical instrument.

2. The musical instrument of claim 1, wherein the body portion comprises a single component.

3. The musical instrument of claim 1, wherein the body portion comprises a plurality of components.

4. The musical instrument of claim 1, wherein the at least one rib for altering the resonance of the musical instrument disposed within the first channel or the second channel.

5. The musical instrument of claim 1, wherein the rib is exposed externally to the instrument.

6. The musical instrument of claim 1, wherein the body portion is configured to alter the timbre of the musical instrument.

7. The musical instrument of claim 1, wherein the rib alters the timbre of the musical instrument.

8. The musical instrument of claim 1, wherein the core portion is formed from a plurality of components.

9. The musical instrument of claim 1, wherein the main core portion comprises electronics.

10. The musical instrument of claim 1, wherein the body portion attaches to the core portion with fasteners.

11. The musical instrument of claim 1, wherein the body portion is solid.

12. The musical instrument of claim 1, wherein the body portion is hollow.

13. The musical instrument of claim 1, wherein the body portion is semi-hollow.

14. The musical instrument of claim 1, wherein the body portion is open-ended.

15. The musical instrument of claim 1, wherein the body portion is closed-ended.

16. The musical instrument of claim 1, wherein the body portion is made of wood.

17. The musical instrument of claim 1, wherein the body portion is made of metal.

18. The musical instrument of claim 1, wherein the body portion is made of plastic.

19. The musical instrument of claim 1, wherein the body portion is made of carbon fiber.

20. The musical instrument of claim 1, wherein the body portion is made of a composite material.

21. The musical instrument of claim 1, wherein the core portion is made of wood.

22. The musical instrument of claim 1, wherein the core portion is made of metal.

23. The musical instrument of claim 1, wherein the core portion is made of plastic.

24. The musical instrument of claim 1, wherein the core portion is made of carbon fiber.

25. The musical instrument of claim 1, wherein the core portion is made of a composite material.

26. The musical instrument of claim 1, wherein the musical instrument is a stringed instrument.

27. The musical instrument of claim 1, wherein the musical instrument is a guitar.

28. The musical instrument of claim 1, wherein the body portion is a body of a guitar.

29. The musical instrument of claim 1, wherein the body portion is removably attached to the core portion.

30. A stringed musical instrument comprising:

a neck portion disposed between a main core portion and a headstock portion, wherein the neck, main core, and headstock portions comprise a single component, continuous structure;

a body portion attachable to the neck portion, the body portion including at least first and second sections that include respective first and second channels; and at least one rib adjacent to and interacting with the body portion, wherein the rib alters the resonant characteristics of the stringed instrument.

31. The stringed instrument of claim 30, wherein the body portion comprises a single component.

32. The stringed instrument of claim 30, wherein the body portion comprises a plurality of components.

33. The stringed instrument of claim 30, wherein the body portion comprises a first section and a second section.

34. The stringed instrument of claim 30, wherein the stringed instrument is a guitar.

35. The stringed instrument of claim 30, wherein the body portion is removably attached to the neck portion.

36. A method of making a musical instrument having exchangeable components, comprising:

providing a core portion comprised of a single continuous component, said core portion providing at least main core, neck, and headstock portions, wherein said core portion further structurally supporting the musical instrument;

providing a body portion, the body portion being removably attachable to the core portion and including at least first and second sections that include respective first and second channels;

inserting a rib adjacent to and interacting with the body portion, wherein the rib alters the resonant characteristics of the musical instrument; and attaching the body to the core portion.

* * * * *